United States Patent [19]

Meyer

[11] Patent Number: 4,987,734

[45] Date of Patent: Jan. 29, 1991

[54] RING SPINNING MACHINE

[75] Inventor: Urs Meyer, Niederglatt, Switzerland

[73] Assignee: Rieter Machine Works, Ltd., Winterthur, Switzerland

[21] Appl. No.: 309,611

[22] Filed: Feb. 10, 1989

[30] Foreign Application Priority Data

Feb. 12, 1988 [CH] Switzerland ..... 00525/88

[51] Int. Cl.[5] ..... D01H 1/20; D01H 1/22

[52] U.S. Cl. ..... 57/100; 57/83; 57/97; 19/236; 19/258

[58] Field of Search ..... 57/83, 97, 100, 315; 19/258, 263, 236, 239, 240

[56] References Cited

U.S. PATENT DOCUMENTS

| | | | |
|---|---|---|---|
| 4,228,642 | 10/1980 | Dakin et al. | 57/83 X |
| 4,336,684 | 6/1982 | Hartmannsgruber et al. | 19/293 X |
| 4,473,924 | 10/1984 | Hartmannsgruber et al. | 19/293 X |
| 4,480,355 | 11/1984 | Vignon et al. | 19/293 X |
| 4,703,431 | 10/1987 | Sako et al. | 19/240 X |

FOREIGN PATENT DOCUMENTS

| | | |
|---|---|---|
| 0074932 | 3/1983 | European Pat. Off. . |
| 3347113 | 4/1986 | Fed. Rep. of Germany . |
| 3442080 | 5/1986 | Fed. Rep. of Germany . |
| 0548941 | 9/1972 | Switzerland . |
| 0822355 | 10/1959 | United Kingdom . |
| 2044302 | 10/1980 | United Kingdom . |

*Primary Examiner*—Stuart S. Levy
*Assistant Examiner*—Steven M. duBois
*Attorney, Agent, or Firm*—Kenyon & Kenyon

[57] ABSTRACT

The ring spinning machine has separate drives for the spindles, the delivery rollers and the other rollers of the drafting device. The inverters of the corresponding drive motors are fed from a D.C. intermediate circuit so that all the drives stop simultaneously, thus obviating thread breakages. A disc brake is electrically coupled to the intermediate circuit to prevent rotation of the delivery roller of the drafting device.

13 Claims, 1 Drawing Sheet

RING SPINNING MACHINE

Figure 1:
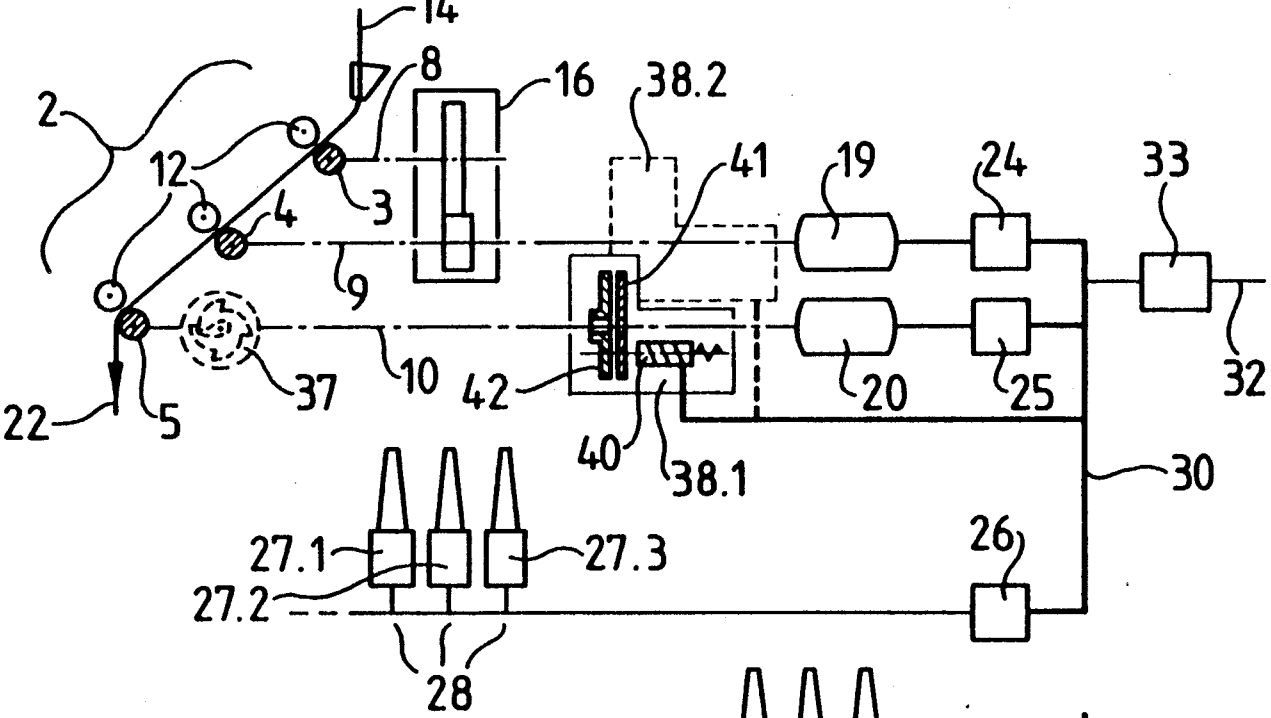

The invention relates to a ring spinning machine. More particularly, this invention relates to a braking arrangement for a drafting device of a ring spinning machine.

Ring spinning machines of this kind in which production can be changed over quickly from one yarn number to another, face a particular problem in the event of a sudden current failure, something which may occur many times a day in some countries. In conventional ring spinning machines, a central motor drives the common drive shaft of the spinning stations via a mechanical speed variator, the common drive shaft extending from the drive head. Gearwheels in the end head provide the connection between the spinning station drive shaft and the change gearwheels of the drafting devices. The drafting devices and spindles are thus directly connected mechanically. On stoppage of the machine, all the drafting device shafts are blocked by self-locking of the coupled drives. One example of such a machine is described in European Patent Application No. 0074932.

There are, however, already machines with individual motors for the spinning stations and the drafting devices, both motors being preceded by an inverter so that electrical synchronism of the two motor shafts is obtained. The yarn twist is adjusted by change gearwheels in the drafting device gear. There is now no rigid mechanical coupling between the spindles, on the one hand, and the drafting devices, on the other hand. On stoppage of the machine, all the drafting device shafts are blocked by self-locking of the coupled drafting device shafts. UK Patent Application No. 2 044302 describes a machine having individual spindle drives wherein individual drive motors are fed jointly by an inverter (a frequency converter), while another inverter supplies the drafting device gear. A breakdown into two inverters is necessary because the spindle motors require a much higher frequency than the drafting device drive motor in accordance with their high speeds. The frequencies of the two inverters are determined by a common set-value signal and are in a fixed ratio to one another to define the yarn twist. The yarn twist is therefore no longer changed at the gearbox, but purely electronically by appropriate adjustments to the inverters. On stoppage of the machine, all the shafts of the drafting device are blocked by self-locking of the coupled drafting device shafts.

Ring spinning machines have also been known wherein the spinning stations and at least the delivery rollers of associated drafting devices are drivable separately from one another by electric motors fed by frequency inverters and wherein each frequency inverter is coupled with a D.C. or D.C.-voltage intermediate circuit with a backstop or arresting means provided for at least the delivery rollers of the drafting devices. However, in the absence of a mains voltage, the self-locking is not adequate to guarantee the joint stoppage of all the drives. The residual forces occurring in the drafting zone between the individual rollers are able to rotate the delivery rollers in particular in the reverse direction. Each rotary movement of the delivery roller without simultaneous rotation of the twist means of the spinning station and the other rollers of the drafting device, however, immediately results in a thread break or a considerable yarn fault when the spinning machine is restarted.

Accordingly, it is an object of this invention so to devise a ring spinning machine having a central electronic changeover of the yarn numbers wherein in the event of an unexpected current failure followed by a resumption of operation neither thread breaks nor unintentional yarn irregularities can occur.

Briefly, the invention provides a ring spinning machine comprising a plurality of spinning stations and a plurality of drafting devices each of which has a delivery roller and each of which cooperates with a drive shaft for driving of the delivery rollers. In addition, an electric motor is provided for driving the spinning station and a second electric motor is provided for driving the shaft of the delivery roller.

In accordance with the invention, a frequency inverter is connected to each motor for feeding current thereto and each frequency inverter is connected to an intermediate D.C. electrical circuit for the supply of current. Also, a braking means is provided which is operable between a standby state and an operational state in dependence on the state of the intermediate circuit whereby in the operational state, the braking means prevents rotation of the drive shaft and, thus, the delivery rollers of the drafting devices.

By having the operational state or the standby state of the braking means dependent on the state of the intermediate circuit, it is possible to bring the set value for all the drives jointly to zero in a ramp function. This ramp function must be so designed that at least one of the three drives must be braked so powerfully relative to its moment of inertia that the associated inverter takes over the supply to the D.C. intermediate circuit. Thus, the energy is available to brake all the drives jointly controllably until standstill.

By preventing the rotation of the delivery roller, a thread break due to a back rotation of the delivery roller is prevented.

The braking means may be electrically coupled to the intermediate circuit so as to come into operation electrically in the absence of voltage in the intermediate circuit. Alternatively, the braking means may move into the operational state in response to a low voltage in the intermediate circuit.

Figure 2:
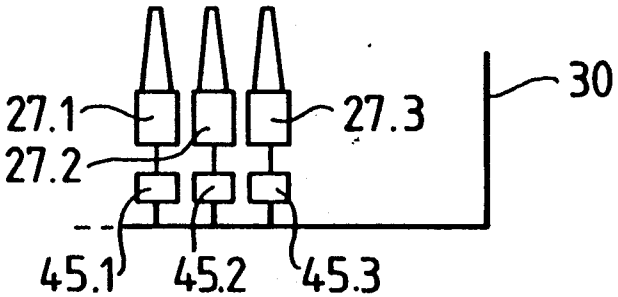

These and other objects and advantages of the invention will become more apparent from the following detailed description taken in conjunction with the accompanying drawings wherein:

FIG. 1 schematically illustrates a ring spinning machine constructed in accordance with the invention: and FIG. 2 illustrates a modified embodiment in accordance with the invention.

Referring to FIG. 1, the ring spinning machine includes a plurality of drafting devices 2, only one of which is shown. Each drafting device 2 includes a feed roller 3, a middle roller 4 and a delivery roller 5, all of which are driven by separate drive shafts 8, 9, 10 which extend over the entire machine length in order to drive the rollers of the respective drafting devices. In addition, non-driven pressure rollers 12 are disposed for engagement with the rollers 3, 4, 5.

When in use, a slubbing 14 is drawn with a fixed ratio in a preliminary drafting zone between the feed roller 3 and the middle roller 4. In addition, a main draft takes place between the middle roller 4 and the delivery roller 5.

As indicated, the drive shafts 9, 10 are driven directly by electric motors 19, 20. The drive shaft 8 is driven off the drive shaft 9 via a distribution gear 16. The construction illustrated permits an electronic adjustment of the draft and, hence, of the yarn number. The main draft is electronically adjustable by the ratio of the speeds of the motors 19, 20 so that it is possible to determine the cross-section of the yarn or thread 22 which is to be produced.

As indicated, each motor 19, 20 is supplied by a respective inverter 24, 25.

The ring-spinning machine also has a plurality of spinning stations 28 each of which includes a spindle and a spindle drive motor 27.1, 27.2, 27.3. These motors are, in turn, supplied by a third inverter 26.

The three inverters 24, 25, 26 are supplied by way of a common D.C. intermediate circuit 30 which is fed from a mains 32 via a rectifier 33.

As shown, a braking means in the form of a backstop (or freewheel clutch) 37 of commercially known construction, for example, as described in U.S. Pat. No. 4,332,059, is provided on the drive shaft 10 for the delivery roller 5. This arrangement is useful since the delivery roller 5 tends to rotate in the reverse direction after stoppage of the machine so that the thread 22 inevitably breaks. Although the delivery roller 5 is particularly at risk, a backstop (not shown) may also be provided on the drive shaft 9 to the middle roller 4.

Alternatively, the braking means may be form of an arresting means 38.1, such as an electromagnetic brake, for example, a conventional mechanical single-disc spring pressure brake with electromagnetic external tripping.

As indicated, the arresting means 38.1 has a magnet coil 40 which is electrically connected to the intermediate circuit 30. During operation, as soon as the speed of all of the drives has dropped to zero, the voltage in the intermediate circuit 30 also disappears. The magnet coil 40 thus automatically becomes de-energized so that a moveable clutch disc 41 is pressed by compression springs (not shown) against a fixed clutch plate 42 so that the delivery roller 5 becomes blocked. For additional security, a second identical arresting means 38.2 may be mounted on the drive shaft 9 for the middle roller 4 and may also be electrically coupled to the intermediate circuit 30.

Referring to FIG. 2, wherein like reference characters indicate like parts as above, each individual spindle drive motor 27.1–27.3 may be connected to an individual inverter 45.1–45.3. Also, one inverter may be provided for a group of individual spindle drive motors.

In another embodiment, it is possible to use separate intermediate circuits, such as D.C. or D.C.-voltage intermediate circuits for the spindles and for the drafting device, for example, as shown in FIG. 2 of German O.S. No. 3412060. In this case, it is no longer possible to supply energy from the spindles to the drafting device during the stoppage of the machine. Instead, a buffer battery and/or a flywheel mass, such as described in Swiss Pat. No. 548,941 or German O.S. No. 3442080 may be used in order to keep the highly resistant parts rotating. In this case, the drafting device drive also includes a D.C. or D.C.-voltage intermediate circuit and the triggering of the backstop or arresting means can be made dependent upon the state of this intermediate circuit. For example, the backstop or arresting means can be actuated, that is moved from a standby state to an operational state, when the voltage in the intermediate circuit has reached a predetermined low level. This can be effected automatically since the backstop or arresting means can be held in the standby state only while the intermediate circuit has a predetermined energy condition.

Alternatively, the backstop or arresting means can be actuated into the operational state indirectly via a sensor which reacts to the state of the intermediate circuits to trigger actuation of the backstop or arresting means. Electrical energy for actuating the backstop or arresting means could also be drawn from a storage device or another intermediate circuit. The energy required could, however, also be available in non-electrical form such as from a spring or a pneumatic energy storage means.

The expression "highly resistant" used above refers to resistance to continued rotation after removal of drive, for example due to frictional drag of associated parts. The drive motor(s) for the drafting device are preferably synchronous motors. The spindle motors can be asynchronous motors.

What is claimed is:

1. A ring spinning machine comprising
a plurality of spinning stations;
at least one drafting device having a delivery roller and a drive shaft;
a first electric motor for driving said spinning station;
a first frequency inverter connected to said motor for feeding current to said motor;
a second electric motor for driving said shaft;
a second frequency inverter connected to said second motor for feeding current to said second motor;
at least one intermediate electrical circuit connected to said frequency inverters for supplying current thereto; and
braking means electrically coupled to said electrical circuit and being operable between a standby state and an operational state in dependence on the state of said intermediate circuit whereby in said operational state said means prevents rotation of said shaft and said delivery roller.

2. A ring spinning machine as set forth in claim 1 wherein said operational state of said braking means corresponds to an absence of voltage in said intermediate circuit.

3. A ring spinning machine as set forth in claim 1 wherein each said spinning station includes a drive motor and said spinning stations are distributed longitudinally of the machine, said first inverter being connected in common to said spindle motors.

4. A ring spinning machine is set forth in claim 1 wherein each spinning station includes a drive motor and said first inverter is connected to at least one of said drive motors.

5. A ring spinning machine as set forth in claim 1 further comprising a pair of said intermediate circuits interconnected to each other, one of said circuits being connected to said first inverter and a second of said circuits being connected to said second inverter.

6. A ring spinning machine as set forth in claim 1 wherein said braking means is a backstop on said drive shaft.

7. A ring spinning machine as set forth in claim 1 wherein said braking means is an electromagnetic brake.

8. A ring spinning machine as set forth in claim 1 wherein said operational state of said braking means corresponds to a predetermined low voltage in said intermediate circuit.

9. A ring spinning machine comprising
a drafting device having a delivery roller;
a drive shaft for driving said delivery roller;

a first electric motor for driving said shaft;

an intermediate electrical circuit for supplying current;

a first inverter connected to and between said circuit and said first motor;

a spinning station having a spindle;

a second electric motor for driving said spindle;

a second inverter connected to and between said circuit and said second motor; and braking means for said drive shaft electrically coupled to said circuit and operable between a standby state and an operational state in dependence on the state of said circuit whereby in said operational state said braking means prevents rotation of said drive shaft.

10. A ring spinning machine as set forth in claim 9 wherein said circuit is a D.C. circuit.

11. A ring spinning machine as set forth in claim 10 wherein said braking means is one of a backstop and a electromagnetic brake.

12. A ring spinning machine as set forth in claim 9 wherein said operational state of said braking means corresponds to a state of predetermined low voltage in said circuit.

13. A ring spinning machine as set forth in claim 9 wherein said operational state of said braking means corresponds to an absence of voltage in said circuit.

* * * * *